United States Patent [19]

Tanaka et al.

[11] Patent Number: 4,637,567

[45] Date of Patent: Jan. 20, 1987

[54] DEVICE FOR CONTINUOUSLY CUTTING AND WINDING A WEB

[75] Inventors: Keiji Tanaka, Kanagawa; Hatsuo Honryo; Takeri Koga, both of Tokyo, all of Japan

[73] Assignee: Fuji Photo Film Co., Ltd., Kanagawa, Japan

[21] Appl. No.: 545,974

[22] Filed: Oct. 27, 1983

[30] Foreign Application Priority Data

Oct. 29, 1982 [JP] Japan ..... 57-163220[U]

[51] Int. Cl.[4] ..... B65H 19/26; B65H 19/28; B26D 1/08

[52] U.S. Cl. ..... 242/56 R; 83/697

[58] Field of Search ..... 242/56 R, 56 B, 56.6; 83/424, 614, 697

[56] References Cited

U.S. PATENT DOCUMENTS 4,069,729 1/1978 Kuts ..... 83/614 X 4,368,855 1/1983 Schonmeier et al. ..... 242/56 R

FOREIGN PATENT DOCUMENTS 2743258 3/1979 Fed. Rep. of Germany ..... 83/697

3125553 1/1983 Fed. Rep. of Germany .... 242/56 B

OTHER PUBLICATIONS

Japanese Application 47-3248.

Japanese Application 51-116373.

Japanese Application 56-89497.

*Primary Examiner*—Harvey C. Hornsby

*Assistant Examiner*—Scott J. Haugland

*Attorney, Agent, or Firm*—Sughrue, Mion, Zinn, Macpeak, and Seas

[57] ABSTRACT

A device for continuously cutting and winding a web includes a cutter blade mounted so that a flat portion thereof is maintained in elastic contact with an outer surface of a web winding roll so as to prevent the web from creasing and folding as it is being cut.

4 Claims, 4 Drawing Figures

DEVICE FOR CONTINUOUSLY CUTTING AND WINDING A WEB

BACKGROUND OF THE INVENTION

This invention relates to a device for continuously cutting and winding a web.

In a calender device wherein a web (e.g., a paper tape, a magnetic tape or a photosensitive film) is wound on a first web winding roll, it is necessary, after the first roll is full, to shift the web onto a second new roll. For this purpose, the web is cut at a location between the new (second) web winding roll and a downstream guide roll using a cutting device. The web thus cut is wound on the new web winding roll.

Japanese Published Patent Application No. 3248/1972 discloses a cutting device for cutting such a web, the cutting device including a cutter blade which is reciprocated in a direction parallel to the axis of the new web winding roll so that the web can be cut by the cutter blade. Similar cutting devices are disclosed in Japanese Published Patent Application Nos. 116373/1976 and 89497/1981. These conventional cutting devices are similar to one another in that the cutter blade of each is moved in the widthwise direction of the web using air pressure, and the cutter blade is positioned substantially perpendicular to the surface of the web. When a web is cut with such a conventional cutting device, the cut end portion of the web tends to be displaced in the direction of a guide roll located adjacent to the new web winding roll, and accordingly is creased as the web is wound on the new web winding roll. The creasing is caused by an undesirable shock imparted to the web as the cutter blade contacts the web so as to have a perpendicular attitude relative to the web, especially since the web is maintained under tension. The undesirable shock varies the web tension causing the creasing. The creasing and variable tension considerably lower the quality of the web.

SUMMARY OF THE INVENTION

Accordingly, it is an object of the present invention to provide an apparatus for continuously cutting and winding a web so that the web can be cut without being creased and folded.

This and other objects are achieved by providing a cutter blade which is mounted to a cutter blade moving means so that a part of a flat portion of the cutter blade is elastically brought into contact with the new web winding roll.

While the cutter blade is moved so as to cut the web, a cutting edge of the cutter blade is moved aslant with respect to the surface of the web, and the cutter blade accordingly pushes the web against the new web winding roll. Accordingly, the contact surface between the web and the blade is maintained stable during the cutting operation. Thus, the aforementioned difficulties can be readily eliminated according to the present invention. In addition, conventional means for moving the cutter blade mounted in this manner can be utilized.

Therefore, according to the present invention, a device for continuously cutting and winding a web in which a web is cut between a new web winding roll and a guide roll with a cutter blade which is moved in the axial direction of the new web winding roll includes a cutter blade made of an elastic metal plate having a cutting edge, with the cutter blade being mounted so that at least a part of a flat portion of the cutter blade is maintained in elastic contact with the outer surface of the new web winding roll behind the cutting edge while the cutter blade is being moved.

DESCRIPTION OF THE PREFERRED EMBODIMENTS

Figure 1:
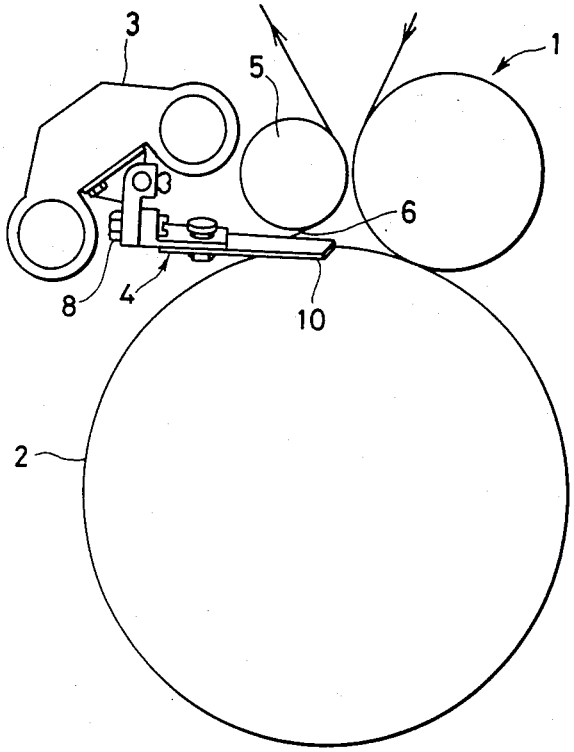
FIG. 1 is a side view showing one embodiment of a device, which is in a standby state, for continuously cutting and winding a web according to the invention.

A device 1 for continuously cutting and winding a web includes a body 3 which extends along an axial direction of a new (or second) web winding roll 2. The body 3 is slidably supported by a guide pipe 12 provided parallel to the axial direction of the roll 2 so as to move along the pipe 12 using air pressure. A cutter blade 4 is fixedly secured to the body 3. The cutter blade 4 is mounted so as to be movable in-between the roll 2 and a guide roll 5 located near the roll 2 so as to cut a web 6 transported to the new web winding roll 2 as the cutter blade 4 is moved along the axial direction of the roll 2 by means of the body 3. The body 3 may move the cutter blade 4 according to a method disclosed, for instance, by Published Japanese Patent Applications Nos. 3248/1972 and 89497/1981, or, alternatively, by using a linear motor.

Figure 2:
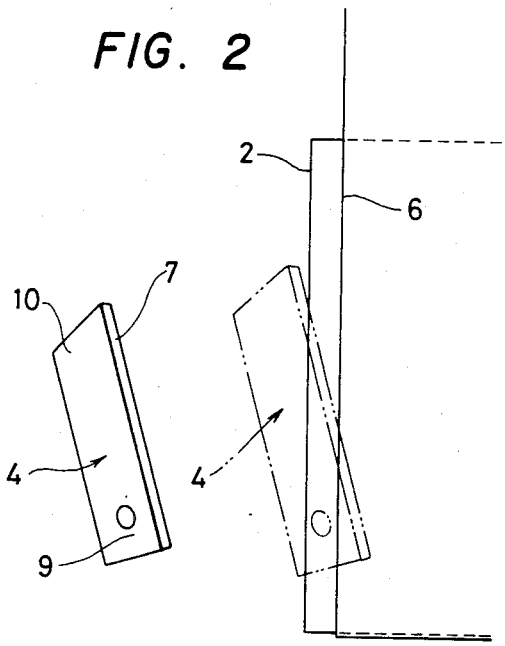
FIG. 2 is a plan view showing the positional relation between the cutter blade and a winding roll.

The cutter blade 4 is made of an elastic metal plate and has a cutting edge 7. The cutter blade 4 is tightened to the body 3 with a bolt 8 so as to be inclined to the axial direction of the roll 2. That is, the cutter blade 4 is inclined along a widthwise direction thereof. As shown in FIG. 1 or 2, during a standby period in which the cutter blade 4 is not in use, the cutter blade 4 is positioned outside the new web winding roll. In addition to being inclined with respect to the axial direction of the roll 2 as described above, the cutter blade 4 is also inclined in such a manner that its mounting base 9 is closer to the roll 2 than the top 10 of the cutter blade 4. As indicated by the phantom lines in FIG. 2, when the cutter blade 4 moves in the axial direction of the new web winding roll 2, the former inclination prevents the cutting edge 7 from directly contacting the outer surface of the roll, and the latter inclination causes the cutter blade 4 to pass over the new web winding roll 2 begining at a position on the blade 4 near the mounting base 9.

These inclinations prevent the cutting edge 7 from breaking and allow a flat portion of the cutter blade 4 to contact the outer surface of the new web winding roll 2 behind the cutting edge 7. By controlling the position and angle of the cutter blade 4 in the standby state, a part or all of the cutter blade 4 can be selectively brought into contact with the new web winding roll 2, so that the cutting and winding operation can be carried out in the best mode in compliance with the properties of the web.

Figure 3:
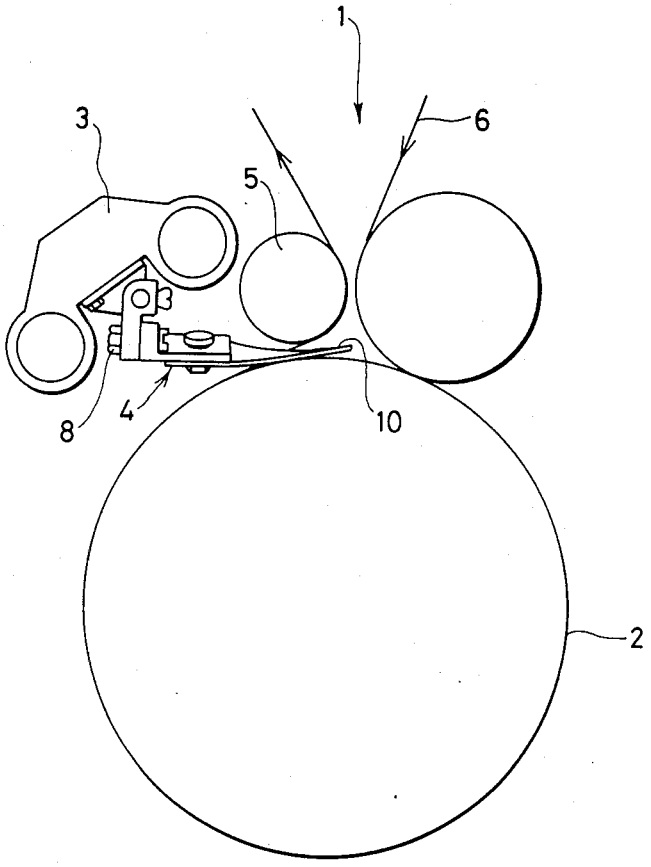
FIG. 3 is a side view showing the relation between the winding roll and the cutter blade as it is cutting the web.
Figure 4:
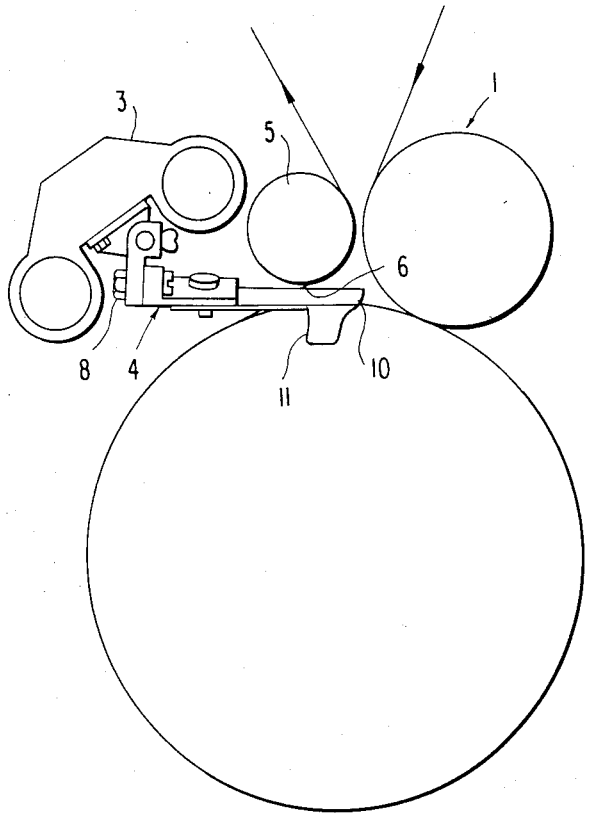
FIG. 4 is a side view of a second embodiment of the device according to the invention.

The cutter blade 4 may stand by in such a manner that it is in contact with the new web winding roll 2. When the flat portion of the cutter blade 4 is in contact with the outer surface of the new web winding roll 2, the web 6 is cut by the cutting edge 7 while the web 6 thus cut is held in close contact with the outer surface of the roll 2. Accordingly, the cut end portion of the web is maintained flat. Such a construction is effective in preventing the cut end portion of the web from being folded or creased as it is dragged by air. As the mounting base 9 of the cutter blade 4 is closer to the new web winding roll 2 than the top 10 as shown in FIG. 2, the cutting edge 7 forms an acute angle with the web 6, thus effectively cutting the web 6. In cutting the web, the cutter blade 4 twists as shown in FIG. 3.

The cutter blade 4 may be so modified such that a tongue-shaped piece 11 is formed in the flat of the cutter blade 4 in such a manner that is is bent downwardly, and the tongue-shaped piece 11 thus formed is brought into elastic contact with the outer surface of the new web winding roll during cutting. The web may be moistened before it reaches the new web winding roll 2 so that it is well fitted to the roll 2 after being cut.

While the invention has been described in detail and with reference to specific embodiments thereof, it will be apparent to one skilled in the art that various changes and modifications can be made therein without departing from he spirit and scope thereof.

We claim:

1. A device for continuously cutting and winding a web, comprising:

a web winding roll;

a guide roll;

means for cutting a web movable in-between said web winding roll and said guide roll, said cutting means including a cutter blade made of an elastic metal plate, said cutter blade having a cutting edge and a flat portion; and means for moving said cutter blade along an axial direction of said web winding roll, said cutter blade being mounted to said moving means such that at least a part of said flat portion of said cutter blade is maintained in elastic contact with an outer surface of said web winding roll behind said cutting edge while said cutter blade is moved along said axial direction.

2. The device as claimed in claim 1, wherein said cutter blade includes a mounting base and a top portion, said mounting base being located near an end of said cutter blade opposite an end thereof where said top portion is located, said cutter blade being mounted to said moving means such that said mounting base is closer to said web winding roll than is said top portion of the blade, when said cutter blade is positioned axially displaced from the web winding roll.

3. The device as claimed in claim 2, wherein said cutter blade is mounted to said moving means so as to form an acute angle with said web with respect to a lengthwise direction of said cutter blade.

4. The device as claimed in claim 3, wherein said cutter blade includes a tongue-shaped piece formed on said flat portion, said tongue-shaped piece being bent outwardly from said flat portion so as to be in elastic contact with said outer surface of said web winding roll as said web is cut.

* * * * *